United States Patent [19]

Butts et al.

[11] 4,084,800

[45] Apr. 18, 1978

[54] THERMALLY STABLE INJECTOR LANCE

[75] Inventors: Douglas Earl Butts, Brook Park; Walter Neil Rossborough, Rocky River, both of Ohio

[73] Assignee: Rossborough Supply Company, Cleveland, Ohio

[21] Appl. No.: 658,272

[22] Filed: Feb. 17, 1976

[51] Int. Cl.[2] ..... C21C 7/00

[52] U.S. Cl. ..... 266/225

[58] Field of Search ..... 266/209-210, 266/216-218, 221-226, 265-268, 270

[56] References Cited

U.S. PATENT DOCUMENTS

| | | | |
|---|---|---|---|
| 51,401 | 12/1865 | Bessemer | 266/224 |
| 2,214,612 | 9/1940 | Greenberg | 266/225 |
| 2,906,521 | 9/1959 | Harders | 266/210 |
| 2,985,441 | 5/1961 | Gibson | 266/226 |
| 3,781,001 | 12/1973 | Andrews et al. | 266/222 |
| 3,833,209 | 9/1974 | Chang | 266/225 |
| 3,898,078 | 8/1975 | Huber | 266/225 |
| 3,976,286 | 8/1976 | Thompson et al. | 266/225 |

*Primary Examiner*—Gerald A. Dost
*Attorney, Agent, or Firm*—Fay & Sharpe

[57] ABSTRACT

A thermally stable lance for injecting particulate material into molten metal is provided which comprises an elongated thermal insulating member having spaced apart first and second ends and at least one wall therebetween defining the member; a reinforcing rod axially disposed in the insulating member with one end of the rod extending beyond the first end of the insulating member, the rod having a plurality of outwardly extending protrusions in contact with the said insulating member; a length of wire wound around the reinforcing rod which is in contact with the insulating member; and a hollow injection tube having spaced apart first and second ends axially disposed in the insulating member with the first end thereof extending beyond the first end of the insulating member and the second end extending beyond the second end of the insulating member.

10 Claims, 4 Drawing Figures

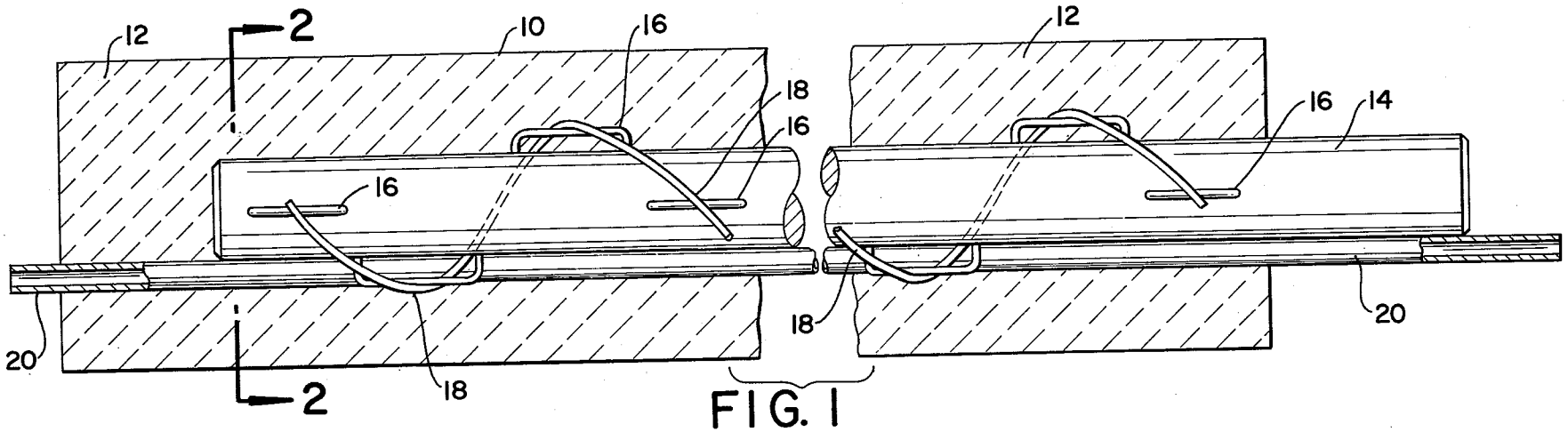
FIG. 1
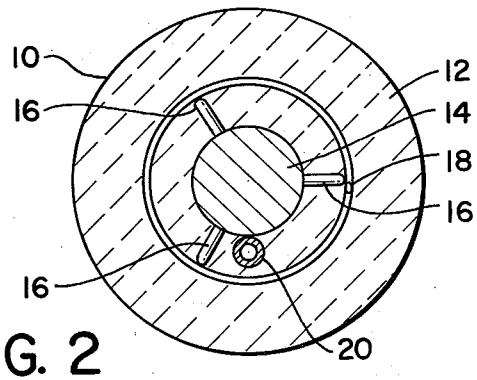
FIG. 2
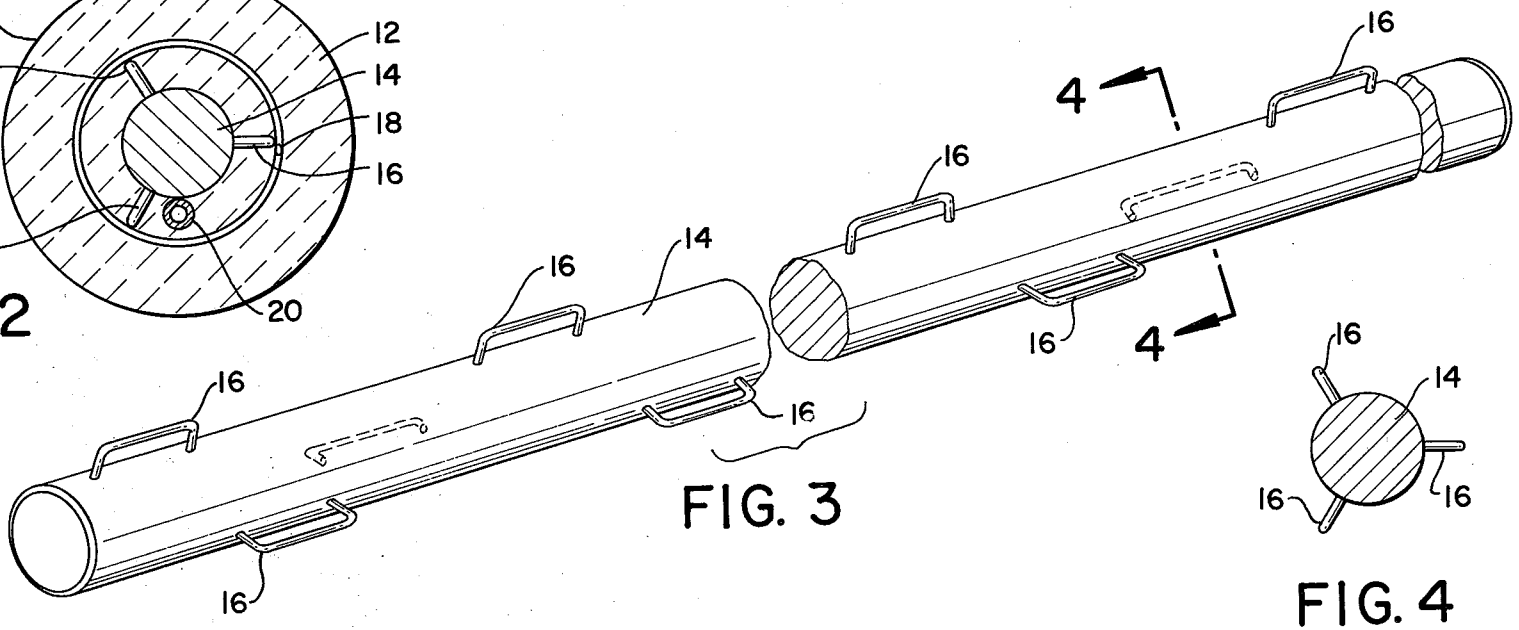
FIG. 3
FIG. 4

THERMALLY STABLE INJECTOR LANCE

BACKGROUND OF THE INVENTION

1. Field of the Invention

The present invention relates to a unique thermally stable lance for injecting particulate materials, such as desulfurizing agents and the like, into molten metal. Broadly, the lance of the invention includes a thermal insulating member, a special reinforcing rod disposed in the insulating member, a length of wire wound around the reinforcing rod and a tubular injection member or tube axially disposed in and essentially surrounded by the insulating member.

2. Description of the Prior Art

It is known to deoxidize molten metal by injecting deoxidizer material directly into the metal to be treated. (See, for example, U.S. Pat. No. 3,575,695). In such a method, the deoxidizer is injected into the molten metal below the surface thereof by means of a hollow cylindrical tube or lance which is encased in a refractory material.

In addition, it is known to desulfurize molten metal, usually iron, by injecting finely divided material, such as calcium carbide and the like, below the surface of the molten metal being treated by means of a hollow tube or lance. (See, for example, U.S. Pat. No. 2,692,196).

In each of the above-described processes a lance or tubular member is employed as the means of bringing the treating agent into contact with the molten metal. While the respective processes generally produce satisfactory results, much difficulty is experienced in connection with the equipment utilized, specifically the lance or tubular injection member. In fact, most lances presently available for the above-described general processes suffer from the fact that they are easily damaged or destroyed during usage or have a limited usable life.

Accordingly, it is the primary object of this invention to provide a lance which can be used to treat molten metal which is characterized by its thermal stability and relatively long usable life.

Additional objects of the invention will be apparent to those skilled in the art from a reading of the following description and claims.

SUMMARY OF THE INVENTION

Broadly speaking, the present invention concerns a lance for injecting particulate materials into molten metal which comprises an elongated thermal insulating member having spaced apart first and second ends and at least one wall therebetween defining the member; a reinforcing rod axially disposed in the insulating member with one end of the rod extending beyond the first end of the insulating member, the rod having a plurality of outwardly extending protrusions in contact with the insulating member; a length of wire wound around the reinforcing rod which is in contact with the insulating member; and a hollow injection tube having spaced apart first and second ends axially disposed in the insulating member with the first end extending beyond the first end of the insulating member and the second end extending beyond the second end of the insulating member.

BRIEF DESCRIPTION OF THE DRAWINGS

FIG. 1 is a diagrammatic sectional view of a lance of the invention.

FIG. 2 is a cross-sectional view of a lance of the invention taken along line 2—2 of FIG. 1.

FIG. 3 is an isometric view of a typical reinforcing rod used in the practice of the invention.

FIG. 4 is an end view of the reinforcing rod shown in FIG. 3.

DESCRIPTION OF THE PREFERRED EMBODIMENT OF THE INVENTION

The preferred embodiment of the invention can best be appreciated by referring to the drawings. Accordingly, referring now to FIGS. 1 and 2, there is shown in cross-section the lance 10 of the invention which includes thermal insulating member 12 having reinforcing rod 14 axially positioned therein. The thermal insulating member is refractory in nature and preferably fabricated from the type of material hereinafter described.

The reinforcing rod 14 is provided with a plurality of outwardly extending protrusions 16. These protrusions are shown in the preferred form, that is, as substantially U-shaped metal rungs. However, it is apparent that these rungs may take other forms such as solid or perforated fins and the like. These protrusions extend into the insulating member and help to bond the reinforcing rod and thermal insulating member together. As can be seen from FIGS. 3 and 4, preferably the metal rungs 16 extend outwardly from the reinforcing rod 14 along the length of the rod with each rung being positioned about the circumference of the rod about 120° out of line with the next adjacent rung.

As shown in FIG. 1, a length of wire 18 is spirally wound around the reinforcing rod 16 and affixed to the metal rungs 16. The wire is attached to the rod, for example, by brazing or welding, and it extends into the thermal insulating member. However, it is not essential that a spiral winding be utilized. All that is required is that the wire, at least in part, extend into the thermal insulating member for the purpose of reinforcing it.

An injection tube 20 is axially disposed in the thermal insulating member 12. This tubular member may have either one or a plurality of openings extending therethrough and can be fashioned from either one or more hollow tubes, e.g., concentric tubes.

Lances produced according to the teachings of the instant invention are especially well suited for injecting desulfurizing agents, such as particulate magnesium-aluminum alloys, into molten metal, usually iron. While the lance of the subject invention is not limited to any particular size or configuration, lances used to desulfurize molten iron generally are cylindrical in shape, having a length ranging from about 9 to 15 feet and a diameter ranging from about 6 to 12 inches.

The thermal insulating member can be fabricated from any suitable refractory material. All that is required is that during use (1) it provides sufficient thermal insulation for the component parts of the lance and (2) not be destroyed when brought into contact with the molten metal being treated.

A typical refractory material for this purpose is a commercially available product known as wire encast. This product is basically a high alumina material having slivers or short lengths of wire, usually, about one inch in length, mixed therein. This material is simply used to encapsulate the various other components of the lance of the invention. The exterior of the thermal insulating material, and hence the lance, may take any suitable form, with the most desired form being cylindrical.

Another thermal insulating material which is highly satisfactory for use in the practice of the invention consists of, by weight, about 60 percent alumina, about 31 percent silica, about 1.4 percent iron oxide, about 1.8 percent titanium dioxide, about 3.0 calcium oxide, with the balance being incidental impurities.

The refractory insulating material is simply mixed with a suitable plasticizer or binder, usually water, and then applied to the other components of the lance. The so-applied material is then thoroughly dried. In fact, it has been found that in order to obtain extended lance life the thermal insulating material should be dried to a degree such that it exhibits an electrical resistance of at least about 2,000 megohms.

The reinforcing rod can be fabricated from any suitable material, such as carbon steel. In practice, the rod usually has a length of about 8 to about 15 feet and a diameter of about 1¾ to about 2 inches. One end of the rod can be treated, if desired.

One end of the reinforcing rod usually extends about 3 to about 6 feet beyond the end of the thermal insulating material. This extension is used to connect the lance to a suitable lance holder. The opposite end of the reinforcing rod usually is encapsulated by the thermal insulating member. Obviously, the reinforcing rod can be one piece or segmented. For example, the reinforcing rod may be totally encapsulated in the thermal insulating member and provided with a means, such as threads, for engaging a means for supporting the lance.

Metal rungs are positioned along the length of the reinforcing rod. These rungs are usually fabricated from one-fourth inch cylindrical carbon steel stock. They extend from the surface of the rod about 1 to 1¼ inches and are about 8 to 9 inches long. In general, they are positioned around the circumference of the rod about 120° out of line with each adjacent rung. These rungs can be spaced apart over the length of the rod or they can be attached in an overlapping manner. In practice, there usually are about 1.25 rungs per foot of reinforcing rod. All that is critical is that the rungs contact the thermal insulating material.

The injection tube member usually extends from both ends of the thermal insulating member. However, this is not critical. Obviously, the injector tube can be flush with or recessed into the thermal insulating member. The injector tube can be one piece or segmented. In its preferred form, however, the lower end of the rod usually extends about 1 to 3 inches from the lower surface of the thermal insulating member, with the upper end extending an amount necessary to bring it into communication with the injector apparatus, usually about 2 to about 3 feet. The injection tube is preferably affixed to the reinforcing rod, for example, by means of spaced apart welds for the purpose of providing added strength to the lance. However, this arrangement is not critical. All that is required is that the injector tube be thermally insulated.

Carbon steel wire is generally used to reinforce the thermal insulating member. In practice, it has been found that barbed wire is exceptionally well suited for this purpose. Preferably, the wire is brazed or welded to the rungs extending from the surface of the reinforcing member so as to fix it in place. The steel wire is simply spirally coiled around the reinforcing rod with the coil generally extending over the length of the rod which is encapsulated in the thermal insulating member. Generally, about 1¼ turns of wire per rung are utilized. However, the number of turns can be varied as desired. What is essential is that the wire be in contact with the thermal insulating member for the purpose of reinforcing the same. As before noted, the rungs extending from the reinforcing member can take various forms, i.e., they can be solid or provided with apertures therein.

The injector tube usually is fabricated from carbon steel cold rolled, seamless pipe stock. The size of the aperture in the injector tube is a function of the type and amount of material to be used. For example, when desulfurizing molten iron with a magnesium-aluminum alloy, it is preferred to have an aperture in the tube of about one-half inch. The exact size of opening desired can be achieved either by use of a single tube having the desired size of aperture therein or by combining a plurality of tubes to effect the desired size of opening.

A lance of the type described herein has been utilized to desulfurize molten metal. For example, a lance of the type described hereinbefore has been used to inject particles of magnesium-aluminum alloy into molten iron to desulfurize the same. The lance so used was not destroyed and was subsequently utilized for the same purpose.

While there have been described herein what are at present considered to be the preferred embodiments of the invention, it will be obvious to those skilled in the art that various changes and modifications may be made therein without departing from the spirit and scope of the invention as hereinafter claimed. For example, it is not necessary that the lance of the invention be cylindrical in shape or that the reinforcing rod be centrally located in the thermal insulating member.

We claim:

1. A lance for injecting particulate material into molten metal which comprises:

an elongated thermal insulating member having spaced apart first and second ends and at least one wall therebetween defining the member;

a reinforcing rod axially disposed in the insulating member, said rod having a plurality of outwardly extending protrusions in contact with said insulating member;

a length of wire wound around the reinforcing rod in a spaced apart relationship and affixed to at least one of said protrusions with said wire being in contact with the insulating member;

and a hollow injection tube having spaced apart first and second ends axially disposed in the insulating member.

2. The lance of claim 1 wherein one end of said reinforcing rod extends beyond the first end of said insulating member.

3. The lance of claim 1 wherein the said first end of said injection tube extends beyond said first end of said insulating member and said second end extends beyond said second end of said insulating member.

4. The lance of claim 1 wherein said thermal insulating member is cylindrical in shape.

5. The lance of claim 1 wherein said reinforcing rod is centrally positioned in said thermal insulating member.

6. The lance of claim 1 wherein at least one of said protrusions is in the form of a rung.

7. The lance of claim 6 wherein said rung is substantially U-shaped.

8. The lance of claim 1 wherein said wire is spirally wound around said reinforcing rod.

9. The lance of claim 1 wherein said injection tube is affixed to said reinforcing rod.

10. The lance of claim 1 wherein said injection tube comprises a plurality of concentric tubes.

* * * * *